United States Patent [19]

Jacobs, Sr.

[11] 4,220,107

[45] Sep. 2, 1980

[54] WIND CONTROLLED SELF-STEERING MECHANISM

[76] Inventor: Terrence D. Jacobs, Sr., 6056 College Ave., Oakland, Calif. 94618

[21] Appl. No.: 41,986

[22] Filed: May 24, 1979

[51] Int. Cl.[3] ..... B63H 25/04

[52] U.S. Cl. ..... 114/144 C; 46/93

[58] Field of Search ..... 114/144 C, 144 E, 144 R, 114/144 A, 91, 97, 98, 39; 46/93

[56] References Cited

U.S. PATENT DOCUMENTS

| | | | |
|---|---|---|---|
| 1,136,476 | 4/1915 | Macé | 46/93 |
| 1,981,908 | 11/1934 | Dugan | 46/93 |
| 3,765,362 | 10/1973 | Gitchel | 114/144 A |

FOREIGN PATENT DOCUMENTS

| | | | |
|---|---|---|---|
| 916251 | 1/1963 | United Kingdom | 114/144 C |

*Primary Examiner*—Sherman D. Basinger

*Attorney, Agent, or Firm*—Charles K. Epps

[57] ABSTRACT

A self-steering mechanism for a sailboat is disclosed in which a chain connects the boom to a stabilizer, and transmits a force proportional to the resultant force of the velocity and angle of the wind caught by the mainsail. The stabilizer presses against a pressure sensing member linked to the boat's rudder, causing the rudder to rotate to set and maintain a tack for a particular wind velocity and angle. The steering mechanism automatically responds to changes in the wind by adjusting the rudder to keep the boat on its original course, or by setting a new tack.

8 Claims, 4 Drawing Figures

WIND CONTROLLED SELF-STEERING MECHANISM

BACKGROUND OF THE INVENTION

This invention relates primarily to toy or model yachts, but it may be used in sailing vessels of any size. The principal object of the invention is to provide means by which the velocity and direction of the prevailing wind control the vessel and keep it on its course. Prior art systems traditionally have used wind vanes to sense the direction of the wind, and, through intricate systems of pulleys and cables connected to the rudder, to change the course of the craft in response to changes in the wind. This invention relies upon a combination of both the wind's angle and velocity to determine the vessel's course, and eliminates entirely the need for pulleys and cables.

SUMMARY OF THE INVENTION

If a sailboat's sail were allowed unrestrained movement, it would align itself parallel to the direction of the wind to present as little resistance to the wind as possible. The sail's tendency to orient itself in this manner provides the motive force to control the steering mechanism in this invention.

A connecting means such as a short length of chain is attached between the boom and a pivotal member called the stabilizer. When the sail attempts to align itself parallel to the wind direction, the chain pulls the stabilizer against a pressure sensing member positioned to block further movement of the stabilizer unless it exerts pressure in excess of a pre-determined level. When the stabilizer exerts less than this pressure, it creates a torque which turns the boat's rudder and establishes a tack for the vessel. The boat stays on this tack so long as the resultant force of the velocity and angle of the wind remains constant.

If there is a decrease either in the velocity of the wind or in the angle at which it strikes the sail, the vertical stabilizer exerts less pressure upon the pressure sensing member and the rudder returns to a position more nearly in alignment with the boat's centerline axis. The change in rudder orientation compensates for the change in the wind and keeps the boat approximately on the same course it had been followin previously.

If the wind velocity or angle increases, the sail pulls harder upon the stabilizer. When this pull exceeds the predetermined level, it overcomes the resistance of the pressure sensing member and the stabilizer disengages the pressure sensing member, removing all pressure therefrom. At that moment, a counterbalancing weight causes the rudder to offset itself from the boat's centerline axis and turn the vessel into the wind. As the boat turns, it gathers enough momentum to carry it through the upwind direction, and it continues turning until the boom shifts to the opposite side of the mast and pulls the stabilizer back against the pressure sensing member. The rudder then turns to establish another tack, and the boat stays on its new course until the sail applies sufficient pressure to again disengage the stabilizer from the pressure sensing member.

DESCRIPTION OF THE PREFERRED EMBODIMENT

Figure 1:
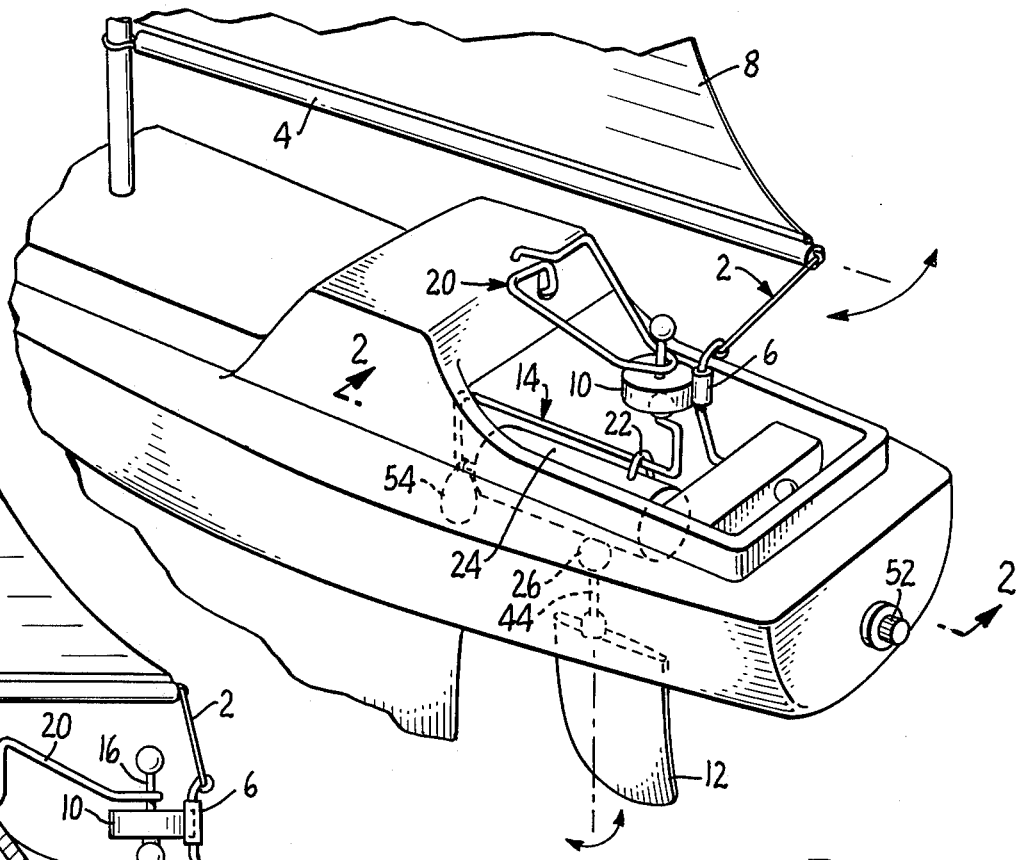
FIG. 1 is a rear partial perspective view of a sailboat equipped with the present invention.

Referring now to FIG. 1, a chain 2 connects the sailboat's boom 4 to a stabilizer 6 mounted so that it pivots in a plane generally perpendicular to the boat's centerline axis. As the wind fills the mainsail 8, the boom 4 swings and pulls the stabilizer 6 against a pressure sensing member 10, which is a wheel in the preferred embodiment. The wheel is mounted on a mechanism linking it to the rudder 12, and moves only when the stabilizer exerts enough force to overcome a predetermined resistance.

Figure 2:
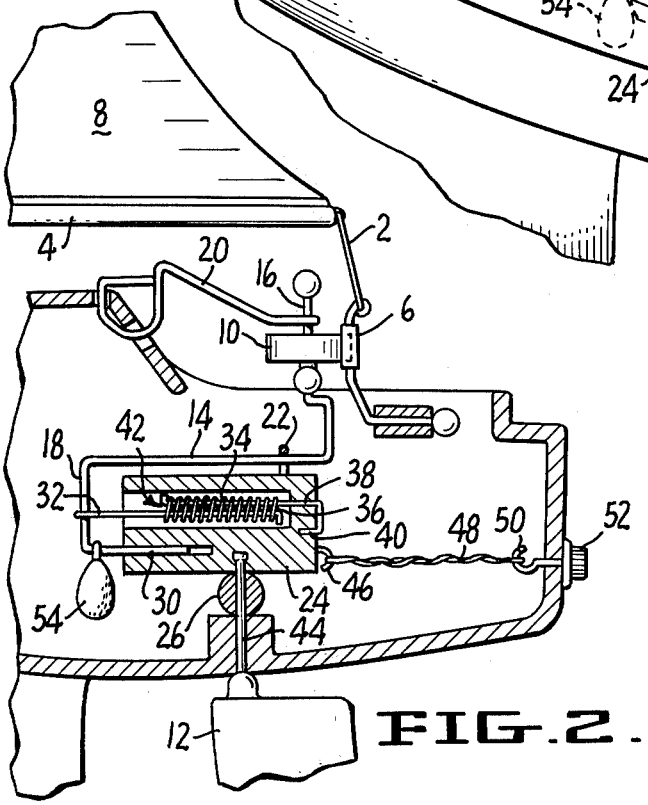
FIG. 2 is a side cutaway view of the sailboat along the centerline axis 2—2 of FIG. 1 looking in the direction of the arrows.

The mechanism linking the wheel to the rudder is comprised of a stiff wire 14, best seen in FIG. 2, which has an upright portion 16 upon which the wheel is mounted, and a generally U-shaped portion 18. Another wire 20 provides mechanical stability to the free end of the upright portion, and a hook 22 holds the U- shaped portion in position along the upper surface of a cylinder 24. The cylinder, which can pivot in a horizontal plane, is mounted upon a bead 26 resting upon a support member 28. The end 30 of the U-shaped portion fits snugly into a cavity in the cylinder. A wire 32 with one end attached to the U-shaped portion of the stiff wire 14 passes through the center of a compressed spring 34 and has its other end attached to the spring at the spring's first extremity 36. Another wire 38 connects to the aft surface 40 of the cylinder and also passes through the spring, attaching to the spring at its second extremity 42. The spring pulls the U-shaped portion snugly against the surface of the cylinder as it tries to expand. The spring also can be compressed by the stiff wire 14 when the stiff wire moves in response to pressure exerted by the vertical stabilizer upon the pressure activated member. As explained hereinafter, compression of the spring allows sufficient movement of the stiff wire and the wheel to permit the vertical stabilizer to disengage itself by slipping past the wheel.

A shaft 44 connects the rudder to the cylinder and has threaded ends so that it can be screwed to the cylinder and so that the rudder can be replaced easily if it becomes damaged. A hook 46 on the aft end of the cylinder has an elastic band 48 stretched between it and another hook 50 mounted on the boat's transom. The tension created by the stretched elastic band acts to keep the lengthwise axis of the cylinder, and thus the lengthwise axis of the rudder, parallel to the vessel's centerline axis. This tension may be varied by means of an adjustable screw 52 which permits the spacing between the hooks 46 and 50 to be varied. The tension created by the elastic band regulates the rudder rotation in response to the pressure exerted by the stabilizer.

In actual operation, the mainsail fills with wind and tries to align itself parallel to the direction of the wind to present as little resistance as possible. As the boom swings to accomplish this alignment, it takes the slack out of the chain and pulls upon the stabilizer. The stabilizer is mounted to pivot in an arc in a plane generally perpendicular to the boat's centerline axis. Were the stabilizer unhindered, the chain would pull it from one extreme of its arc to the other as the boom moved. However, the wheel is positioned to block the free motion of the stabilizer, and it pivots through its complete arc only when it can push the wheel aside. The wheel can be pushed aside because the stiff wire 14 on which it is mounted compresses the spring 34 if the vertical stabilizer exerts sufficient pressure. The stiffness of the spring, therefore, is what establishes the pre-determined resistance the stabilizer has to overcome before it disengages the wheel.

Figure 3:
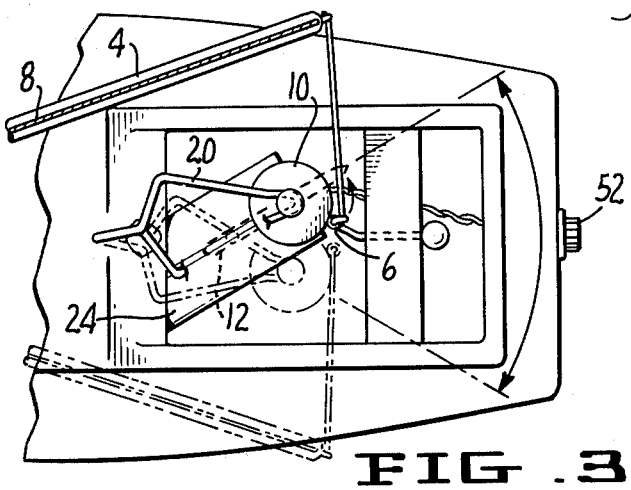
FIG. 3 is a top view showing with solid lines the boom pulling the stabilizer against the pressure sensing member from the starboard side of the vessel, and showing with phantom lines the boom pulling the stabilizer against the pressure sensing member from the port side of the vessel.

If the stabilizer does not exert enough force to overcome the spring's resistance, the wheel blocks its movement in its arc and the sail cannot align itself parallel to the wind. This is the situation depicted by the solid lines in FIG. 3 and FIG. 4. In this state, the stabilizer 6 applies a constant force upon the wheel 10, but not enough to overcome the resistance of the spring 34. The stiff wire 14 transmits this force to the cylinder 24 developing a torque which pivots the cylinder about a vertical axis running through the shaft 44. Rotation of the cylinder 24 turns the attached rudder 12 a few degrees relative to the centerline axis of the boat. The magnitude of the rotation is proportional to the force the stabilizer 6 exerts upon the wheel 10, which in turn is proportional to the resultant force of the velocity and angle of the wind. The rudder rotation is also inversely proportional to the tension of the elastic band 48 which opposes rotation of the cylinder. For a given wind angle and velocity, high tension from the elastic band permits only a small rudder rotation; weak tension permits relatively more. By adjusting the tension of the elastic band with the screw adjustment 52, one controls the vessel's tack.

The sailboat remains on a tack so long as the wind is constant. However, if the wind velocity decreases, or the angle at which it strikes the sail decreases, the resultant force decreases and the boom will not pull as hard upon the stabilizer, consequently exerting less pressure upon the wheel 10. This reduces the torque about the vertical axis through the shaft 44, and the rudder rotates through a relatively smaller angle. The boat will stay approximately on its original course because the change in rudder orientation compensates for the decreased wind.

Figure 4:
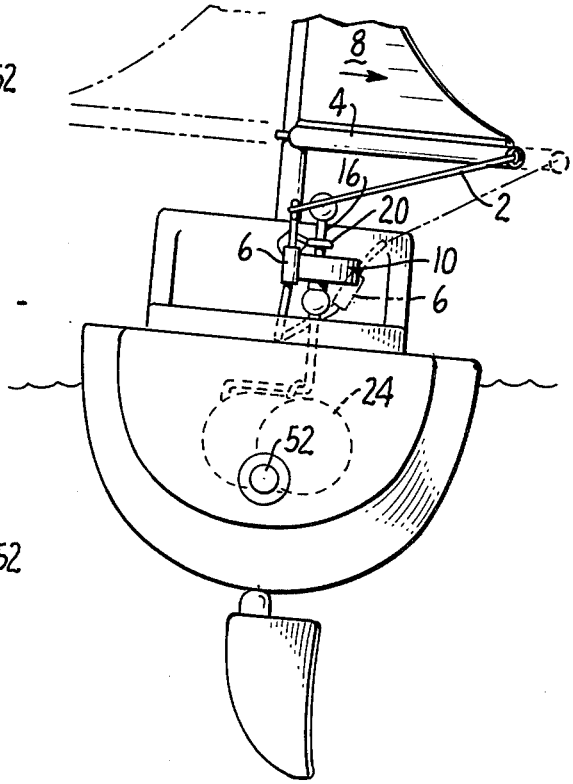
FIG. 4 is a rear view of the sailboat showing with solid lines the boom pulling the stabilizer against the pressure sensing member and showing with phantom lines the stabilizer the moment after it has disengaged the pressure sensing member.

If the wind velocity or angle increases enough to permit the stabilizer to overcome the resistance created by the spring 34, the stabilizer slips past and disengages the wheel 10, falling to the opposite side of the wheel from where it was previously. The solid lines of FIG. 4 show the stabilizer 6 just before it disengages the wheel 10 and the phantom lines show it just after it disengages the wheel. At the instant the stabilizer falls to the opposite side, it exerts no pressure upon the wheel and thus creates no torque about the vertical axis through the shaft 44. With the torque gone, a counterbalancing weight 54 on the forward portion of the cylinder 24 causes the rudder 12 to turn, thereby bringing the blow of the boat into the wind. The vessel acquires enough momentum to swing through and past the upwind direction. When the wind again fills the mainsail, the boom swings to the opposite side of the mast pulling the stabilizer 6 back against the wheel 10 and starting anew the process described above.

It will be apparent from the foregoing description of the invention in its preferred form that it will fulfill all the objects attributable thereto. While it is illustrated and described in detail, the invention is not to be limited to such details as have been set forth except as may be necessitated by the appended claims.

I claim:

1. A steering mechanism for a sailing vessel having a mainsail and boom, a hull and a rudder, comprising (a) a stabilizer mounted to the hull so as to pivot in a plane generally perpendicular to the lengthwise axis of the vessel, (b) means connecting the stabilizer to the boom, said means transmitting to the stabilizer a force proportional to the resultant of the velocity and angle of the wind striking the mainsail, (c) a pressure sensing member upon which the stabilizer presses in response to said force, said pressure sensing member positioned to impede movement of the stabilizer, and (d) a linkage mechanism upon which the pressure sensing member is mounted, said mechanism adapted to turn the rudder when the stabilizer exerts less than a pre-determined force upon the pressure sensing member, and further adapted to permit the stabilizer to disengage the pressure sensing member when the stabilizer exerts greater than a pre-determined force.

2. The steering mechanism of claim 1 further comprising means to turn the rudder so as to bring the vessel's bow into the wind when the stabilizer disengages the pressure sensing member.

3. The steering mechanism of claim 2 further comprising means to control the magnitude of the rudder rotation for a given force exerted by the stabilizer upon the pressure sensing member.

4. The steering mechanism of claim 3 in which the means to control the magnitude of the rudder rotation is an elastic band attached between the linkage mechanism and the hull of the vessel.

5. The steering mechanism of claim 4 wherein the tension of the elastic band may be varied by means of an adjustable screw.

6. The steering mechanism of claim 2 in which the means to turn the rudder so as to bring the vessel's bow into the wind is a counterbalancing weight attached to the linkage mechanism.

7. The steering mechanism of claim 1 in which said linkage mechanism comprises (a) a stiff wire upon which the pressure sensing member is mounted, (b) a cylinder with which the stiff wire is operatively engaged so as to rotate the cylinder about a generally vertical axis when the stabilizer exerts less than a pre-determined force upon the pressure sensing member, (c) a spring connecting the stiff wire and the cylinder, said spring being adapted to pull the wire against the cylinder, and further adapted to permit movement of the stiff wire so as to disengage the stabilizer from the pressure sensing member when the stabilizer exerts in excess of a pre-determined force, and (d) a shaft attached between the cylinder and the rudder to turn the rudder in response to rotation of the cylinder.

8. A steering mechanism for a sailing vessel having a mainsail and boom, a hull and a rudder, comprising (a) a stabilizer mounted to the hull so as to pivot in a plane generally perpendicular to the lengthwise axis of the vessel, (b) a chain connecting the stabilizer to the boom, said chain transmitting to the stabilizer a force proportional to the resultant of the velocity and angle of the wind striking the mainsail, (c) a wheel upon which the stabilizer presses in response to said force, said wheel positioned to impede movement of the stabilizer, (d) a stiff wire upon which the wheel is mounted, (e) a cylinder with which the stiff wire is operatively engaged so as to rotate the cylinder about a generally vertical axis when the stabilizer exerts less than a pre-determined force upon the wheel, (f) a spring connecting the stiff wire and the cylinder, said spring being adapted to pull the wire against the cylinder, and further adapted to permit movement of the stiff wire so as to disengage the stabilizer from the wheel when the stabilizer exerts in excess of a pre-determined force, (g) a shaft attached between the cylinder and the rudder to turn the rudder in response to rotation of the cylinder, (h) an elastic band stretched between the cylinder and an adjustable screw attached to the hull of the vessel to control the magnitude of rudder rotation for a given force exerted by the stabilizer upon the wheel, and (i) a counterbalancing weight attached to the stiff wire to turn the rudder so as to bring the vessel's bow into the wind when the stabilizer disengages the wheel.

* * * * *